US011543175B2

(12) United States Patent
Butenhoff et al.

(10) Patent No.: US 11,543,175 B2
(45) Date of Patent: Jan. 3, 2023

(54) CRISPER

(71) Applicant: AKTIEBOLAGET ELECTROLUX, Stockholm (SE)

(72) Inventors: Yessica Butenhoff, Stockholm (SE); Urban Wählby, Stockholm (SE)

(73) Assignee: Aktiebolaget Electrolux, Stockholm (SE)

( * ) Notice: Subject to any disclaimer, the term of this patent is extended or adjusted under 35 U.S.C. 154(b) by 0 days.

(21) Appl. No.: 16/463,049

(22) PCT Filed: Dec. 19, 2016

(86) PCT No.: PCT/EP2016/081692

§ 371 (c)(1),
(2) Date: May 22, 2019

(87) PCT Pub. No.: WO2018/113899

PCT Pub. Date: Jun. 28, 2018

(65) Prior Publication Data

US 2019/0293342 A1 Sep. 26, 2019

(51) Int. Cl.

| | |
|---|---|
| ***F25D 25/02*** | (2006.01) |
| ***B65D 81/24*** | (2006.01) |
| ***F25D 17/04*** | (2006.01) |
| ***F25D 23/08*** | (2006.01) |

(52) U.S. Cl.

CPC ..... *F25D 25/025* (2013.01); *B65D 81/24* (2013.01); *F25D 17/042* (2013.01); *F25D 23/087* (2013.01); *F25D 2317/0411* (2013.01)

(58) Field of Classification Search

CPC .... F25D 17/042; F25D 23/087; F25D 25/025; F25D 2317/0411; F25D 2325/00; B65D 81/24

See application file for complete search history.

(56) References Cited

U.S. PATENT DOCUMENTS

| | | | | |
|---|---|---|---|---|
| 4,013,434 A * | 3/1977 | Kronenberger | ..... | F25D 17/042 62/382 |
| 4,949,847 A * | 8/1990 | Nagata | ..... | B65D 81/24 206/484.1 |
| 5,074,847 A | 12/1991 | Greenwell et al. | | |
| 5,659,997 A | 8/1997 | Sprehe et al. | | |

(Continued)

FOREIGN PATENT DOCUMENTS

| | | |
|---|---|---|
| CN | 2760473 | 2/2006 |
| CN | 102679679 | 9/2012 |

(Continued)

OTHER PUBLICATIONS

Translation WI2013177928A1, 4 pages (Year: 2013).*

(Continued)

*Primary Examiner* — Andrew M Roersma

(74) *Attorney, Agent, or Firm* — Pearne & Gordon LLP

(57) ABSTRACT

The invention relates to a crisper for preservation of food. The crisper (10) comprises a box (12) and a top (14)—When the crisper (10) is in a closed position the box (12) is air tight sealed to the top (14). A humidity control unit (16) is provided and adapted to allow humid air to exit the crisper via a 5 humidity control membrane (26) located in the humidity control unit (16).

14 Claims, 4 Drawing Sheets

(56) References Cited

U.S. PATENT DOCUMENTS

| | | | | |
|---|---|---|---|---|
| 5,908,649 | A * | 6/1999 | Floyd | A23B 7/144 426/109 |
| 5,918,480 | A * | 7/1999 | Nagata | B22F 3/1125 62/440 |
| 6,862,980 | B2 * | 3/2005 | Heil | A23B 7/152 206/213.1 |
| 7,257,963 | B2 * | 8/2007 | Mayer | C09K 5/063 62/371 |
| 2011/0204762 | A1 * | 8/2011 | Eubanks | F25D 17/042 312/404 |
| 2014/0300264 | A1 | 10/2014 | Park et al. | |
| 2017/0160005 | A1 * | 6/2017 | Park | F25D 29/00 |

FOREIGN PATENT DOCUMENTS

| | | | | |
|---|---|---|---|---|
| CN | 104567195 | | 4/2015 | |
| CN | 105020969 | | 11/2015 | |
| CN | 105917181 | | 8/2016 | |
| DE | 102013225541 | A1 * | 6/2015 | F25D 25/025 |
| DE | 102013226926 | | 6/2015 | |
| EP | 0240955 | | 10/1987 | |
| EP | 2813789 | | 12/2014 | |
| JP | 2000074555 | A * | 3/2000 | F25D 25/025 |
| WO | 2005005024 | | 1/2005 | |
| WO | 2013177928 | | 12/2013 | |
| WO | WO-2015091659 | A1 * | 6/2015 | F25D 17/042 |

OTHER PUBLICATIONS

Translation CN2760473Y, Feb. 22, 2006, 5 pages (Year: 2006).*
Dupont Tyvek Users Manual (Year: 2004).*
Honeywell Intermec Product Profile (Year: 2013).*
Intermec INband-II (Year: 2022).*
Revolution Fabrics—What Exactly is Olefin Fabric (Year: 2013).*
International Search Report for PCT/EP2016/081692, dated Aug. 21, 2017, 3 pages.
Chinese office action for application No. 201680091292.1, dated Nov. 18, 2020, 9 pages.
European office action for application No. 16825368.0, dated Sep. 28, 2021, 7 pages.

* cited by examiner

CRISPER

TECHNICAL FIELD

The invention relates to a crisper for storing food. In particular, the invention relates to a crisper for storing food with a controlled humidity.

BACKGROUND

When preserving food, the food to be preserved can be placed in a container having a controlled environment. Typically, a refrigerator can be provided with a crisper. The crisper is a box used to keep fruits and vegetables stored in an environment where the humidity favors the preservation of the fruits and vegetables.

Most fruits and vegetables prefer to have high humidity environment. One way to obtain a high humidity is to provide a sealed crisper. However, as has been realized condensation might build up in a high humidity environment. Such excess condensation can promote the decay of certain fruits and vegetables through physical or microbiological damage.

There is a constant desire to improve storage and preservation of food. Hence there exists a need for an improved crisper.

SUMMARY

It is an object of the present invention is to provide an improved crisper.

This object is obtained by a crisper as set out in the appended claims.

In accordance with one embodiment a crisper for preservation of food is provided. The crisper comprises a box and a top. When the crisper is in a closed position the box is air tight sealed to the top. The crisper comprises a humidity control unit adapted to allow humid air to exit the crisper via a humidity control membrane located in the humidity control unit. Hereby, the humidity inside the crisper can be controlled by proper selection of the membrane and no further control is required to keep a proper humidity level inside the crisper which is otherwise sealed from the surroundings.

In accordance with one embodiment the box is arranged as a drawer slidably insertable under the top. Hereby a sealable crisper drawer is provided that air tight to provide good preservation of food stored therein.

In accordance with one embodiment the box comprises a gasket on the front side of the box. The gasket can be visible from the outside when the crisper is in a closed position. For example, the gasket can extend to cover a part of the outside of the front side of the box. Hereby, a sealing member that is easy to inspect is provided. As an alternative or as a supplement a gasket can be provided on the front side of the top. The gasket can also be visible from the outside when the crisper is in a closed position.

In accordance with one embodiment the humidity control unit is located in the top. Hereby, the humidity control unit is easily accessible for service and maintenance. For example, for access of the humidity control membrane. Alternatively, the humidity control unit can be located in the box.

In accordance with one embodiment the crisper comprises two boxes. The boxes can then be separate and have different characteristics and be used for storing different type of food. In particular, each of the two boxes can have a separate humidity control unit.

In accordance with one embodiment the humidity control membrane is a Tyvek membrane. Hereby a robust humidity control membrane that is easy to handle and manufacture is provided at the same time as a good humidity control is achieved. The humidity control membrane can have a size of 5-10 $cm^2$ per liter of crisper volume.

In accordance with one embodiment, the humidity control unit has a liftable upper grid member at a top section of the humidity control unit. The humidity control membrane is located directly underneath the liftable upper grid member. Hereby the humidity control membrane can be easily removed for exchange or cleaning.

In accordance with one embodiment a replaceable membrane used in a crisper for preservation of food is provided. The crisper comprises a box and a top. When the crisper is in a closed position, the box is air tight sealed to the top. The membrane has a size of 5-10 $cm^2$ per liter of crisper volume. Hereby a controlled humidity inside the crisper can be obtained. The membrane can be a Tyvek membrane.

BRIEF DESCRIPTION OF THE DRAWINGS

The invention will now be described in more detail, by way of example, and with reference to the accompanying drawings, in which.

DETAILED DESCRIPTION

The invention will now be described more fully hereinafter with reference to the accompanying drawings, in which certain embodiments of the invention are shown. The invention may, however, be embodied in many different forms and should not be construed as limited to the embodiments set forth herein; rather, these embodiments are provided by way of example so that this disclosure will be thorough and complete, and will fully convey the scope of the invention to those skilled in the art. For examples like or similar components of different embodiments can be exchanged between different embodiments. Some components can be omitted from different embodiments. Like numbers refer to like elements throughout the description.

Most fruits and vegetables prefer to have high humidity environment. A sealed crisper is one solution to maintain high humidity. However, condensation might build up in a high humidity environment. This excess condensation might promote the decay of certain fruits and vegetables through physical or microbiological damage. Thus, an introduction of humidity control that allows the excess water vapor to vent through is desired.

Figure 1:
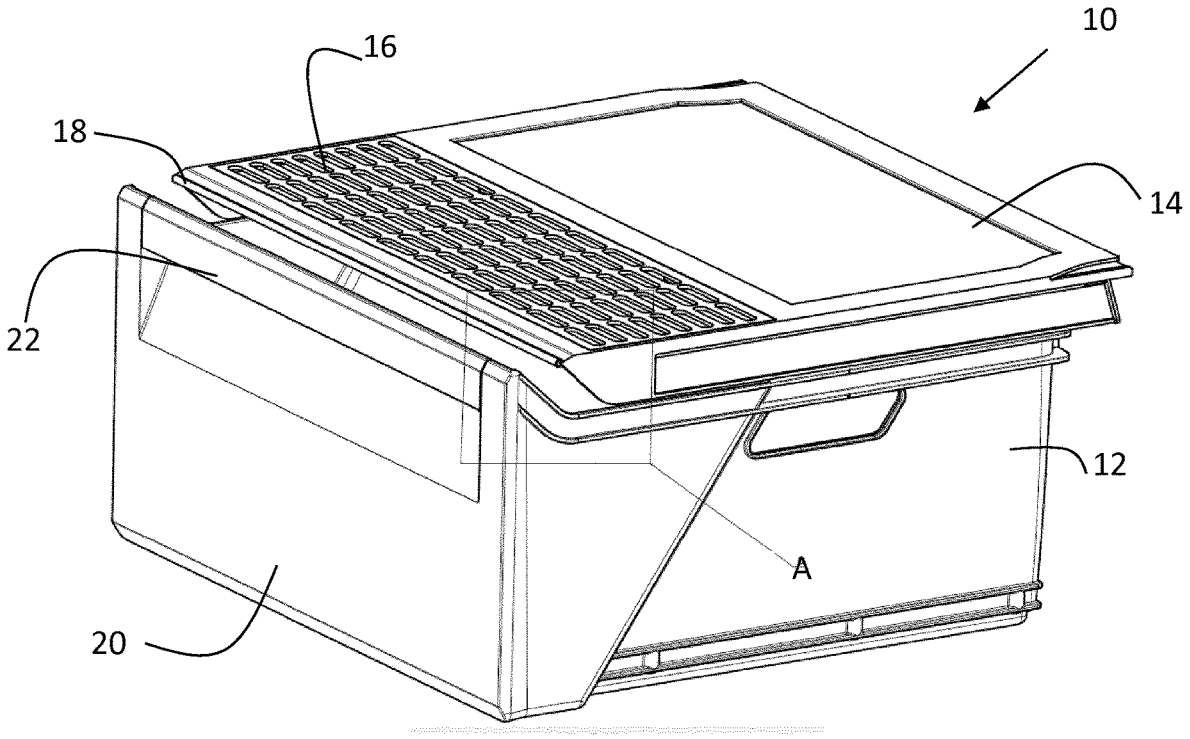
FIG. 1 shows a crisper.

FIG. 1 schematically shows a sealed crisper 10. The crisper 10 comprises a box 12 cooperating with a top 14. The box 12 can in accordance with one embodiment move relative to the top 14 to open/close the crisper. The crisper 10 can in accordance with some embodiments be arranged as a drawer. The box 12 can in accordance with one embodiment be provided with a front section 20 having a handle 22 provided thereon.

Figure 2:
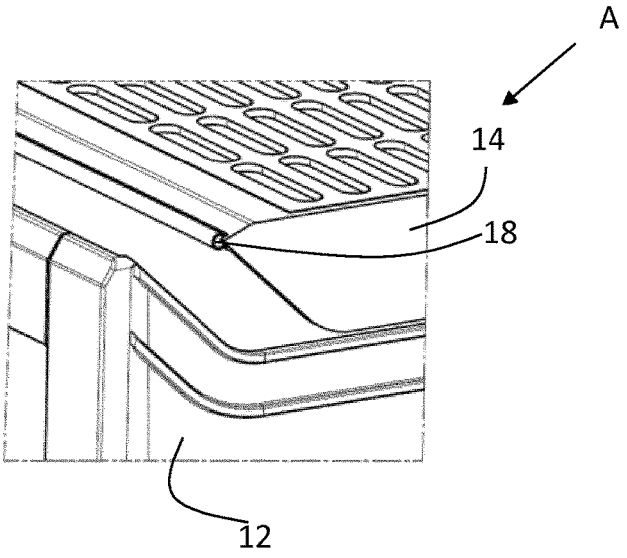
FIG. 2 shows a section of the crisper depicted in FIG. 1.

In the closed position the crisper is sealed in the sense that there is an air tight sealing between the box 12 and the top 14. To ensure an air tight sealing between the box 12 and the top 14, a gasket 18 can be provided on either the front section 20 or the front section of the top 14 or both. In accordance with one embodiment the gasket 18 is formed around the edge of the front section 20 and/or the front section of the top 14 such that the sealing is visible from the outside when the crisper is in a closed position. Hereby the robustness of the sealing facing a user is improved. Also, a user can more easily spot if the gasket 18 is damaged, missing or misaligned thereby impairing the function of the sealed crisper 10. The gasket 18 can be arranged to enclose the front section of the top 14 as is better seen in FIG. 2 which shows a detail A of FIG. 1. It is also envisaged that a gasket similar to the gasket 18 alternatively or as a supplement can be located on the upper front section of the box 12. The gasket 18 can in accordance with some embodiments extend to cover a part of the outside of the top 14 and/or box 12.

The crisper 10 further comprises an automatic humidity control unit 16. The 30 automatic humidity control unit 16 is adapted to automatically let some humidity out from the crisper 10 when the crisper is in a closed position as will be explained in more detail below.

The crisper 10 is designed with minimum air exchange. This is achieved by providing an air tight seal between the box 12 and the top 14 when the crisper 10 is in a closed position. This sealed crisper is capable to get to the optimum storage environment that is needed by the fruits and/or vegetables as quickly as possible. This optimum storage environment is provided by a very low air flow inside crisper and optimum relative humidity. Fruits and vegetables stay fresh, tasty, and crisp.

To control the humidity inside the sealed crisper 10 humid air is allowed to exit the crisper via the automatic humidity control unit 16 where the humidity control unit comprises a humidity control membrane.

Figure 3:
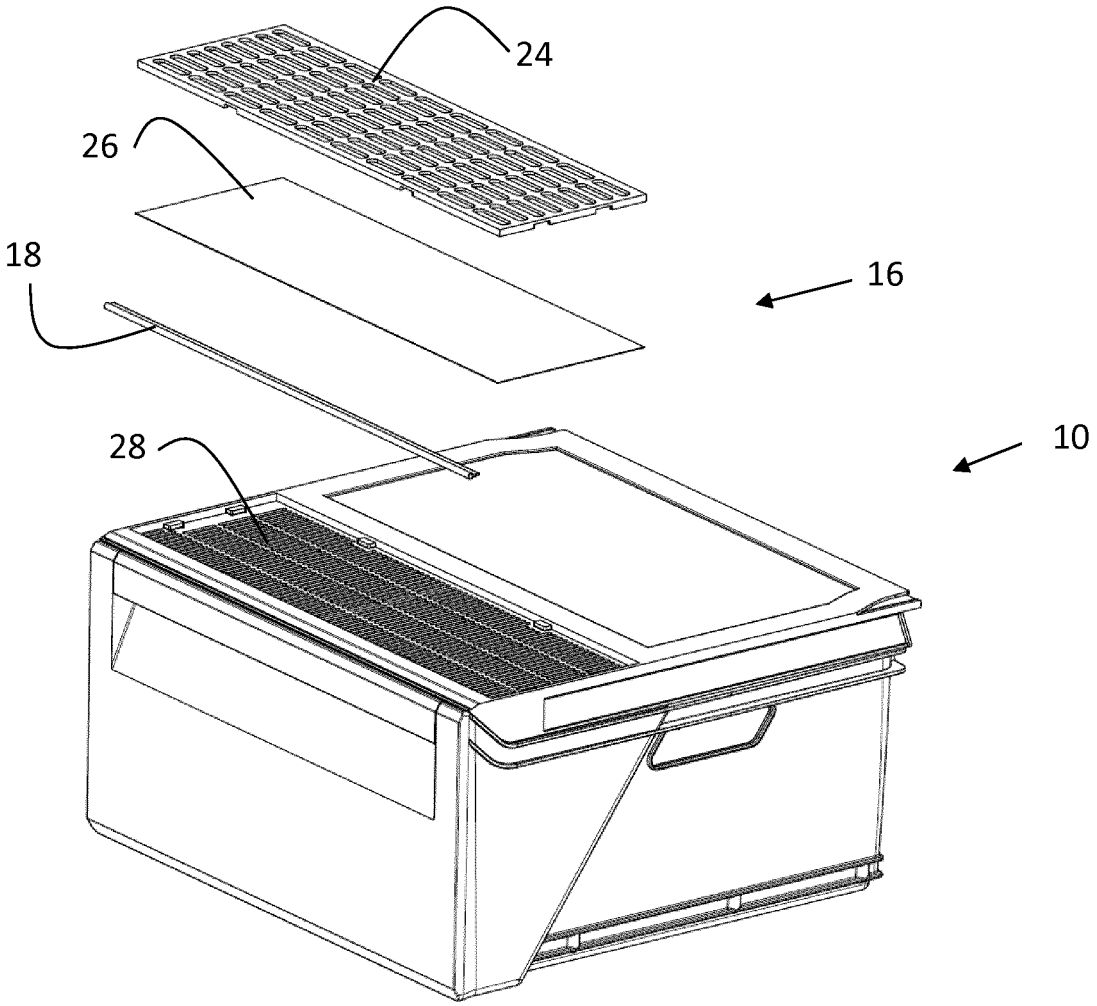
FIG. 3 is an exploded view of a humidity control unit of the crisper depicted in FIG. 1.

In FIG. 3 an exploded view of an exemplary humidity control unit 16 is shown. The humidity control unit 16 comprises a membrane 26 acting to control the humidity in the sealed crisper. The membrane 26 is designed to allow gases, including water vapor, to pass through from the inside of the sealed crisper to the outside of the sealed crisper 10. The only way that gases can exit from the crisper 10 when in a closed position is via the membrane 26. The provision of the membrane 26 is advantageous because completely sealing a crisper, especially when it is fully filled with fruits and/or vegetables, results in higher risk of condensation formation. To reduce this risk, the membrane 26 is introduced as automatic humidity controller.

FIG. 3 further depicts a liftable upper grid member 24 located on top of the membrane 26. The grid member 24 provides easy access to the membrane 26 for replacement of the membrane 26 while at the same time protecting the membrane. The grid member 24 is provided with holes to allow gases pass through the grid member 24. The membrane 26 is placed on top of the housing 28. The bottom of the housing 28 facing the interior of the box 12 is provided with holes to allow gases inside the box 12 reach the membrane located inside the humidity control unit 16.

The crisper is typically placed in a refrigerator. The refrigerator cavity (outside of crisper) has very low relative humidity, while the sealed crisper filled with fruits/vegetables has high relative humidity. This creates vapor pressure gradient across the membrane 26. Over time, some water vapor from sealed crisper will be released to the dry refrigerator cavity thereby automatically controlling the humidity in the crisper 10.

The humidity control can be said to be automatic because the humidity in the crisper 10 does not need any consumer input. Depending on what fruits/vegetables inside the sealed crisper, relative humidity inside the crisper automatically changes. This will affect the vapor pressure gradient across the membrane 26. If the crisper is filled with leafy vegetables that creates very high relative humidity (>90%), more water vapor is transported across the membrane 26. If the crisper is filled with fruits which create medium relative humidity (75-90%), not as much water vapor is transported. By letting gases out from an otherwise sealed crisper via a membrane, the relative humidity of the crisper is reduced by 3-5%. With this reduction, condensation risk is minimized, which is advantageous because condensation is typically not desired.

The membrane can be any suitable type of membrane allowing humid gases to pass at a pre-determined rate at a set humidity pressure gradient. One membrane that can be used is a Tyvek membrane. The membrane is made of spun PE threads which is pressed to form sheets. In accordance with one embodiment, Tyvek 1056D is used. Such a material is difficult to tear thereby improving the robustness of the membrane. The size of the membrane should be designed to match the required level of humidity desired in the crisper.

In accordance with one embodiment the size is set to between 5-10 $cm^2$ per liter of crisper volume, and in particular 6-8 $cm^2$ per liter of crisper volume. In accordance with one embodiment a Tyvek 1056 D membrane having the size 7 $cm^2$ per liter of crisper volume can be used.

Figure 4:
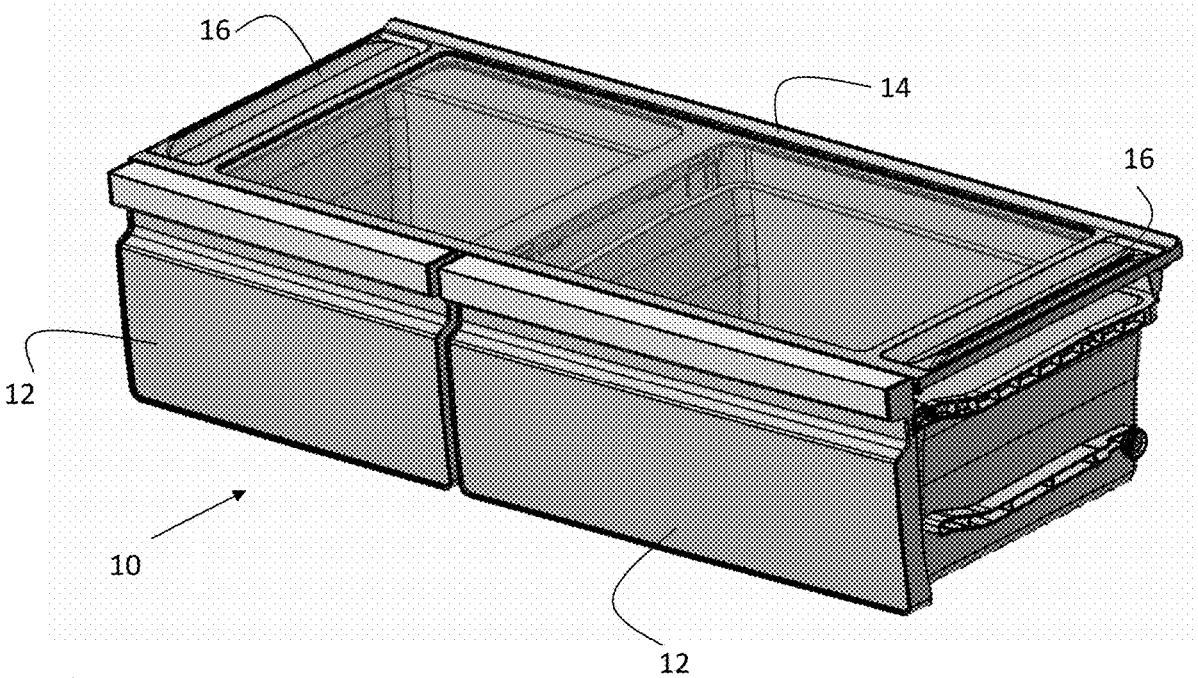
FIG. 4 shows a crisper in accordance with another embodiment.
Figure 5:
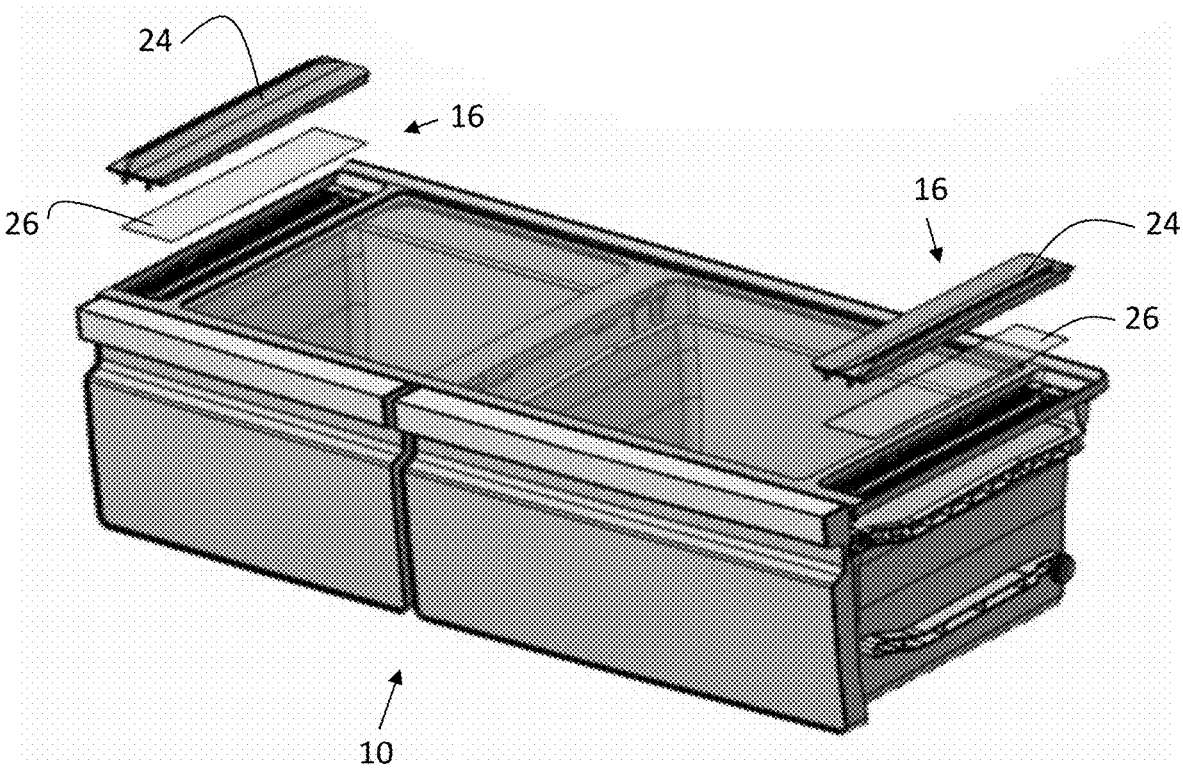
FIG. 5 is an exploded view of a humidity control unit of the crisper depicted in FIG. 4.

In FIGS. 4 and 5 another embodiment of the crisper 10 is depicted. The crisper 10 in FIG. 4 comprises two separate drawers 12 under a top 14. The crisper 10 in FIG. 4 comprises two separate humidity control units 16, one for each drawer 12. The humidity control units 16 are here located on the sides of the top 14 as a difference to the embodiment of FIG. 1 where the humidity control unit is located at the front of the top 14.

In FIG. 5, an exploded view of the humidity control units 16 of FIG. 4 is shown. As can be seen in FIG. 5 also in this embodiment the membranes 26 can be easily accessed for replacement by simply lifting the top grid members 24.

The crisper as described herein has numerous advantages. The crisper is sealed whereby a high humidity in the crisper is obtained. This is advantageous because higher humidity is good for the quality preservation of fruits and vegetables. Further excess condensation on sealed crisper might be a problem that reduce the quality of produce (water that rolls down might pick up some of the unwanted microorganism and increase decay on fruits and vegetables). This is counteracted by the use of membrane provided in the crisper to control opening to let some of the excess humidity to escape to the drier fridge cavity. Hereby, the conditions inside the crisper is humid enough for optimum preservation of fresh produce, with much less condensation incidents likely to occur.

The invention has been described above with reference to a few embodiments. However, as is readily appreciated by a person skilled in the art, other embodiments than the ones disclosed above are equally possible within the scope of the invention, as defined by the appended claims.

The invention claimed is:

1. A crisper for preservation of food, the crisper comprising a box and a top having a front side, a rear side, and a first lateral side and an opposite second lateral side, wherein when the crisper is in a closed position the box is air tight sealed to the top, the crisper further comprising a humidity control unit adapted to allow humid air to exit the crisper via a humidity control membrane located in the humidity control unit, wherein the humidity control membrane extends an entire distance between the first and second lateral sides of the top or an entire distance between the front side and the rear side, and wherein the humidity control membrane is a sheet of pressed spun polyethylene threads and has a size of 5-10 $cm^2$ per liter of crisper volume.

2. The crisper according to claim 1, wherein the box is arranged as a drawer slidably insertable under the top.

3. The crisper according to claim 1, comprising a gasket on a front side of the box, the gasket being visible from an outside when the crisper is in the closed position.

4. The crisper according to claim 1, comprising a gasket on a front side of the top, the gasket being visible from an outside when the crisper is in the closed position.

5. The crisper according to claim 1, wherein the humidity control unit is located in the top.

6. The crisper according to claim 1, wherein the crisper comprises two said boxes.

7. The crisper according to claim 6, wherein each of the two boxes has one said humidity control unit.

8. The crisper according to claim 1, wherein the humidity control unit has a liftable upper grid member at a top section of the humidity control unit and wherein the humidity control membrane is located directly underneath the liftable upper grid member.

9. The crisper according to claim 1, wherein the membrane has a size of 6-8 $cm^2$ per liter of crisper volume.

10. The crisper according to claim 1, wherein the membrane is configured to reduce humidity of the crisper by 3-5%.

11. A replaceable membrane used in a crisper for preservation of food, wherein the membrane is a sheet of pressed spun polyethylene threads and has a size of 5-10 cm' per liter of crisper volume.

12. The replaceable membrane according to claim 11, wherein the membrane is configured to reduce humidity of the crisper by 3-5%.

13. The replaceable membrane according to claim 11, wherein the membrane has a size of 7 $cm^2$ per liter of crisper volume.

14. A crisper for preservation of food, the crisper comprising a box and a top, wherein when the crisper is in a closed position the box is air tight sealed to the top, the crisper further comprising a humidity control unit adapted to allow humid air to exit the crisper via a humidity control membrane located in the humidity control unit, wherein the humidity control membrane is configured to reduce humidity of the crisper by 3-5%, and wherein the humidity control membrane is a sheet of pressed spun polyethylene threads and has a size of 5-10 $cm^2$ per liter of crisper volume.

* * * * *